US005809056A

United States Patent [19]

Jansen et al.

[11] Patent Number: 5,809,056

[45] Date of Patent: Sep. 15, 1998

[54] VITRIFICATION FURNACE WITH A GAS LIGHT SEAL

[75] Inventors: Helge Jansen, Gleichen-Reinhausen; Ludwig Weiler, Heidelberg, both of Germany; Christian Wieckert, Seon, Switzerland

[73] Assignee: ABB K.K., Tokyo, Japan

[21] Appl. No.: 578,475

[22] Filed: Dec. 26, 1995

[30] Foreign Application Priority Data

Dec. 24, 1994 [DE] Germany ..... 44 46 530.0

[51] Int. Cl.[6] ..... H05B 3/66

[52] U.S. Cl. ..... 373/128; 373/8; 373/55; 373/95; 373/119; 219/523; 219/536; 219/542; 392/455; 432/247

[58] Field of Search ..... 219/542, 523, 219/536, 402, 403, 390, 534, 395; 392/455; 373/111, 119, 127, 128, 130, 133, 137, 129, 118, 117, 3, 5, 8, 94, 95, 96, 55; 432/247; 52/506

[56] References Cited

U.S. PATENT DOCUMENTS

| | | | |
|---|---|---|---|
| 1,662,555 | 3/1928 | Wojciechowski | 373/130 |
| 2,735,881 | 2/1956 | Mann | 373/128 |
| 3,009,974 | 11/1961 | Sekkelsten et al. | 373/128 |
| 4,056,678 | 11/1977 | Beall, III et al. | 373/128 |
| 4,080,510 | 3/1978 | Sauder | 432/247 |
| 4,259,538 | 3/1981 | Jones | 373/130 |
| 4,379,382 | 4/1983 | Sauder | 52/506 |
| 5,605,645 | 2/1997 | Brandstadter-Springer et al. | 219/542 |

*Primary Examiner*—Tu B. Hoang
*Attorney, Agent, or Firm*—Herbert L. Lerner; Laurence A. Greenberg

[57] ABSTRACT

A Deglor furnace includes heating elements each having a heater rod being surrounded by a protective tube. The protective tube is mounted on a ceiling of the Deglor furnace and is run through an opening in the ceiling into the interior of the Deglor furnace. Heat insulation of the ceiling which borders the opening is protected against corrosive gases from the interior by a shield.

4 Claims, 1 Drawing Sheet

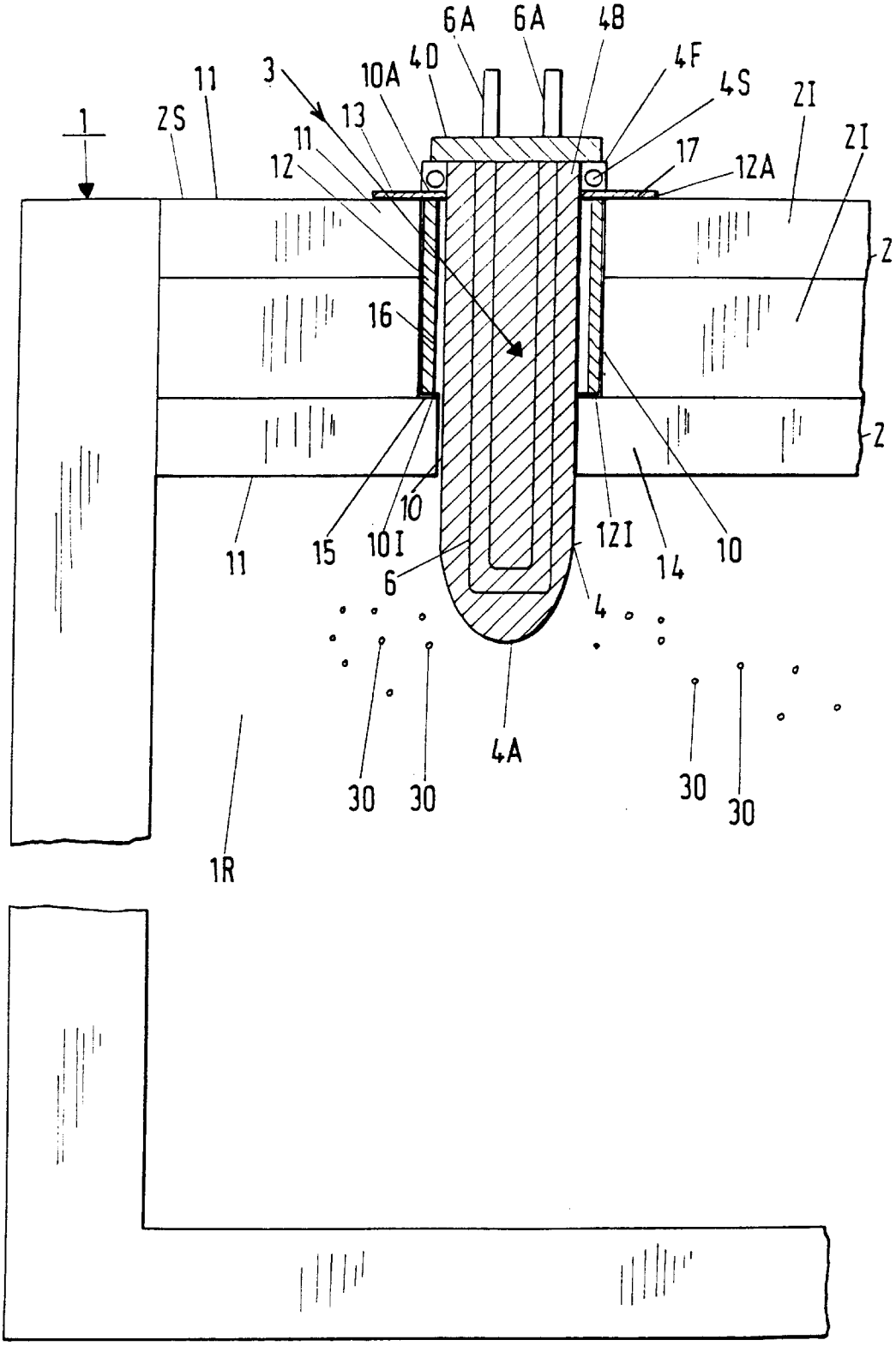
6A
6A
4B
4D
4F
4S
3
10A
11
13
11
12
17
12A
1
2S
2I
2I
2
16
2
10
15
10I
12I
14
10
11
6
4
4A
30
30
30
30
1R

VITRIFICATION FURNACE WITH A GAS LIGHT SEAL

BACKGROUND OF THE INVENTION

FIELD OF THE INVENTION

The invention relates to a Vitrification furnace having at least one heating element with a heater rod being surrounded by a protective tube that is led through an opening in a ceiling into an interior, the protective tube having a flange being mounted on a surface of the ceiling.

Vitrification furnaces are used for vitrifying ash from refuse incineration plants. Contaminants contained in the ash are vaporized and separated off. The vitrified constituents can be used as building materials or landfilled. Deglor furnaces operate at temperatures between 1300° C. and 1500° C. For that purpose, every Vitrification furnace is provided with heating elements in its ceiling area. The heating elements are surrounded on the outside by a protective ceramic tube which is permanently sealed at one end and has a detachable closure at the other end.

Published International Patent Application WO 95/06399, corresponding to U.S. Pat. No. 5,605,645, filed Apr. 26, 1995, discloses a Vitrification furnace in which the protective ceramic tube has a flange at its open end, wherein flange is formed by a metal clip. The clip is attached by one or more bolts to the outside of the protective tube. A U-shaped heating rod is disposed within the protective tube. Its electrical connections are run to the outside through the detachable closure. The flange fixed to the open end of the protective tube is mounted on the surface of the Vitrification furnace and serves as a holder for the heating element. The protective tube is run through an opening in the ceiling into the interior of the Vitrification furnace. The opening is directly bordered by the heat insulation of the ceiling. That is a disadvantage, since gases can pass therethrough from the Vitrification furnace along the outer surfaces of the protective tube to the refractory heat insulation of the ceiling. That is in particular the case when the pressure in the Deglor furnace briefly increases during pulsed cleaning of an exhaust gas filter. The gases and their condensates have a highly corrosive action and very rapidly destroy the heat insulation.

SUMMARY OF THE INVENTION

It is accordingly an object of the invention to provide a Vitrification furnace, which overcomes the hereinaforementioned disadvantages of the heretofore-known devices of this general type.

With the foregoing and other objects in view there is provided, in accordance with the invention, a Vitrification furnace, comprising a ceiling containing heat insulation and having a surface; an interior disposed below the ceiling; at least one heating element having a heater rod; a protective tube surrounding the heater rod, the protective tube having a flange being mounted on the surface of the ceiling, and the protective tube being led through an opening formed in the ceiling into the interior; and a shield being disposed at least in the vicinity of the opening for protecting the heat insulation of the ceiling against corrosive gases from the interior.

In order to ensure that the corrosive gases cannot penetrate from the interior of the Vitrification furnace through the opening as far as the insulating bricks of the ceiling forming the heat insulation, the opening and its rim areas are provided with shielding.

In accordance with another feature of the invention, the shielding has a gas-tight ceramic cylinder. The entire interior of the opening is lined therewith.

In accordance with a further feature of the invention, the cylinder is joined by a refractory cement to the insulating bricks which border the inner surface of the opening.

In accordance with an added feature of the invention, the rim of the opening facing the interior of the Vitrification furnace is covered by one or more panels made of refractory bricks.

In accordance with an additional feature of the invention, the inner brick lining of the Vitrification furnace is also made from these panels. The panels are disposed in such-a way that they directly abut the protective tube of the heating element so that in this way penetration of the gas from the interior into the opening is substantially prevented.

In accordance with yet another feature of the invention, the outward-facing rim of the opening is covered by an annular panel made of stainless steel which also partially lies on the surface of the ceiling. A seal made of fibers is disposed between this panel and the rim of the ceramic cylinder.

In accordance with yet a further feature of the invention, the seal is formed as a mat or cords having the same properties.

The dimensions of the panel are selected in such a way that it directly abuts the protective tube of the heating element.

In accordance with a concomitant feature of the invention, the heating element is held on the surface of the panel. For this purpose, the protective tube of the heating element is provided with an outward-facing flange which is mounted on this panel. The panel is forced against the opening and the cylinder lining the opening by the weight of the protective tube, which achieves an additional sealing of the Deglor furnace to the outside.

Other features which are considered as characteristic for the invention are set forth in the appended claims.

Although the invention is illustrated and described herein as embodied in a Vitrification furnace, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

BRIEF DESCRIPTION OF THE DRAWING

The figure of the drawing is a fragmentary, diagrammatic, longitudinal-sectional view of a Vitrification furnace according to the invention.

DESCRIPTION OF THE PREFERRED EMBODIMENTS

Referring now to the single figure of the drawing in detail, there is seen a section of a Vitrification furnace 1. As can be inferred from the figure, a ceiling 2 is composed of two or more layers of insulating bricks 2I, which serve as heat insulation. The bricks 2I are preferably made of oxidic ceramic. The Vitrification furnace 1 is heated through a multiplicity of heating elements 3, of which one is shown in the figure. Each of these heating elements 3 has a heater rod 6 which is disposed in a protective ceramic tube 4. The protective tube 4 is permanently sealed at its first end 4A, whereas its second end 4B has a detachable cover 4D. The cover 4D can be removed in order to replace the heater rod 6 with another rod if the first rod is defective. Electrical connections 6A of the heater rod 6 are led from the protective tube 4 to the outside through the cover 4D. The protective tube 4 is provided at its second end 4B with an outwardly-facing flange 4F. The flange 4F includes a clip which is fixed through bolts 4S on the outside of the protective tube 4. This flange 4F serves to hold the heating element 3 on a surface 2S of the ceiling 2.

The protective tube 4 passes through an opening 10 which leads from the surface 2S of the ceiling 2 of the Deglor furnace 1 to its interior 1R. The first end 4A and about one third of the length of the protective tube 4 projects into the interior 1R. In order to ensure that no corrosive gases 30 can pass from the interior 1R through the opening 10 to the insulating bricks 2I of the ceiling 2 and to the outside, the opening 10 and its inner and outer rim regions 10I and 10A are surrounded by a shield 11. The shield 11 includes a ceramic cylinder 12 and coverings in the form of an annular stainless steel panel 13 and one or more panels 14 made of refractory bricks. The panels 14 are disposed on a lower surface of the ceiling 2 in such a way that the inwardly-facing rim 10I of the opening 10 is covered by these panels 14. The ceramic cylinder 12 belonging to the shield 11 is dimensioned in such a way that its outer surface directly abuts the insulating bricks 2I. The cylinder 12 is made of $Al_2O_3$, mullite, $MgAl_2O_4$ or another refractory material having the same properties. The cylinder 12 is joined by refractory cement 16 to the insulating bricks 2I. The refractory cement is based on $Al_2O_3$ which binds hydraulically.

A rim 12I of the cylinder 12 facing the interior 1R is mounted on the directly abutting panels 14. Since the panels 14 are led up to the protective tube 4 of the heating element 3, a shoulder is created thereby on which the cylinder 12 can be mounted by its rim 12I. A seal 15 made of fibers which can be formed as a mat or a cord is disposed between the rim 12I of the cylinder 12 and the panels 14. This creates a further protection of the insulating bricks 2I against the corrosive gases 30. The annular stainless steel panel 13 which directly abuts the protective tube 4 is disposed on the outwardly-facing rim 10A of the opening 10 and the rim 12A of the cylinder 12. The panel 13 additionally lies on the surface 2S of the ceiling 2. One or more seals 17 made of fibers are disposed between the panel 13 and the rim 10A of the opening, the rim 12A of the cylinder 12 and the surface 2S of the ceiling 2. These seals 17 are formed as mats. Cords having equivalent properties can also be used as seals. Using the seals 17 prevents gases 30 from being able to pass to the outside from the Vitrification furnace 1.

The heating element 3 is mounted on the surface of the panel 13, and more precisely in such a manner that the flange 4F which surrounds the protective tube 4 is mounted on the panel 13. The panel 13 is pressed against the cylinder 12 and the rim 10A of the opening 10 by the weight of the protective tube 4, in such a way that this achieves a further sealing of the Vitrification furnace 1.

We claim:

1. A furnace for vitrification of ash comprising:

a ceiling containing heat insulation and having an exterior surface;

an interior disposed below said ceiling;

at least one heating element having a heater rod;

a protective tube surrounding said heater rod, said protective tube having a flange being mounted on said surface of said ceiling, and said protective tube being led through an opening formed in said ceiling into said interior;

a shield being disposed at least in the vicinity of said opening for protecting said heat insulation of said ceiling against corrosive gases from said interior;

said opening being defined by an inner surface, a first rim and a second rim, and said shield including at least one gas-tight cylinder lining said inner surface and coverings disposed at said first rim and said second rim;

said cylinder made of ceramic selected from the group consisting of $Al_2O_3$, mullite and $MgAl_2O_4$, and including a refractory cement based on $Al_2O_3$ for permanently joining said cylinder to said inner surface, said opening being bordered by said heat insulation of said ceiling;

at least one corrosion-resistant panel made of refractory bricks for covering said second rim, said at least one panel being led up to said protective tube for said heating element, said at least one panel having a rim, said cylinder having an inward-facing rim and another rim, and a seal, said inward-facing rim of said cylinder being mounted on said rim of said at least one panel with an intermediate insertion of said seal;

a stainless steel panel covering said first rim defining said opening and said other rim of said cylinder, said stainless steel panel in part lying on said exterior surface of said ceiling, and at least one seal disposed between said stainless steel panel and said first rim defining said opening, said other rim of said cylinder and said exterior surface of said ceiling.

2. The furnace according to claim 1, wherein said at least one panel is also a brick lining of the furnace.

3. The furnace according to claim 1, wherein said seal is in the form of a mat made of a material selected from the group consisting of fibers and cords.

4. The furnace according to claim 1, wherein said stainless steel panel has a surface on which said flange of said protective tube is mounted.

* * * * *